United States Patent [19]

Johnson, Jr. et al.

[11] 4,001,546

[45] Jan. 4, 1977

[54] FILM THERMAL PROCESSING

[75] Inventors: Olof C. Johnson, Jr., Chelmsford; Robert E. Whitney; Dieter K. Froehling, both of Burlington, all of Mass.

[73] Assignee: Eikonix Corporation, Burlington, Mass.

[22] Filed: July 14, 1975

[21] Appl. No.: 595,892

[52] U.S. Cl. ..... 219/216; 219/388; 432/60; 432/228

[51] Int. Cl.[2] ..... H05B 1/00

[58] Field of Search ..... 219/216, 388; 355/3 FU; 250/317, 319; 432/59, 60; 100/227, 228, 93 RP

[56] References Cited

UNITED STATES PATENTS

| | | | |
|---|---|---|---|
| 3,397,630 | 8/1968 | Pratt, Jr. | 250/319 X |
| 3,478,665 | 11/1969 | Umahashi et al. | 219/216 |
| 3,628,440 | 12/1971 | Czarnikow et al. | 219/216 X |
| 3,666,247 | 5/1972 | Banks | 432/60 |
| 3,893,800 | 7/1975 | Wako | 432/60 |

*Primary Examiner*—C. L. Albritton
*Attorney, Agent, or Firm*—Charles Hieken; Jerry Cohen

[57] ABSTRACT

A fixed drum has input, output and developing segments of aluminum to provide a cool input and output segments thermally separated from a heated developing segment maintained at substantially constant temperature. The film to be developed passes beneath a wire at high electrical potential relative to the drum to receive charge from a corona discharge that produces electrostatic forces securing the film to an endless belt that carries the film around the drum wrinkle-free. A pair of input rubber drive rollers drive the belt around the drum. The film to be processed is placed on the belt between the drive roller and drum. An output pair of metal rollers partially drain the charge from the developed film and belt and guide the film toward the exit slot. The inner surface of the belt is electrically conducting low friction tetrafluoroethylene to allow the belt to move freely around the stationary drum. The belt outer surface is silicon rubber which may be impregnated with carbon.

9 Claims, 3 Drawing Figures

FILM THERMAL PROCESSING

BACKGROUND OF THE INVENTION

The present invention relates in general to thermally processing film and more particularly concerns novel apparatus and techniques for thermally processing sheet film automatically and uniformly. This device will process sheet film of any size up to and including roll film. The invention achieves these advantages with a relatively compact inexpensive machine that operates with relatively high reliability.

Very high resolution film, such as that used in air reconnaissance and microfilm applications, is often of a type that develops in response to heat in a dry process. To effect uniform development necessary for providing a high resolution image, it has usually been found important to uniformly heat the entire film surface during the development process with the degree of development related to the product of the temperature to which the film is subjected and the time the temperature is applied to the film. Reasonably satisfactory performance has been obtained for developing long rolls of film; however, difficulties have been encountered in providing methods and means for continuously developing film sheets. Problems include maintaining uniform temperature over the developing heat source, maintaining the film to be developed in contact with the heat source or otherwise establishing a relationship between the heat source and the film sheet so that the film sheet receives uniform development.

Accordingly, it is an important object of this invention to provide methods and means for thermally developing film which overcomes one or more of the problems discussed above.

It is another object of the invention to achieve the preceding object with a continuous process for developing film sheets.

It is another object of the invention to achieve one or more of the preceding objects while uniformly developing each It is still a further object of the invention to achieve one or more of the preceding objects with compact apparatus that is relatively inexpensive, reliable, relatively easy to operate by unskilled personnel and uniformly develops film to produce high resolution images with negligible development deterioration in the image quality.

SUMMARY OF THE INVENTION

According to the invention, there is drum means having thermally and electrically conducting input and output segments thermally separated from a developing segment, means for heating the developing segment so that its temperature is higher than that of the input and output segments, conducting flexible belt means movable around and in contact with said drum means for carrying film to be developed around said drum means and transferring developing heat therethrough from said developing segment to the film to be developed, and means for establishing an electrostatic field and corona discharge between a source of a high potential and said drum means through said belt means for producing static electricity and corresponding electrostatic forces securing the film to be developed to said belt means.

According to another feature of the invention there are input and output roller means for moving said belt means and film carried thereby between said belt means and said source of a high potential then around said drum means passing in order opposite said input segment, said developing segment and said output segment and then across said output roller means, said input roller means being made of insulative material and said output roller means being made of conducting material for discharging static electricity from said belt means as it passes across said output roller means.

The drum means is preferably hollow and the input and output segments comprise a channel for maintaining the belt and film at a temperature lower than that of said developing segment. There is heating means in contact with the developing segment and means for controlling the energy delivered to the heating means for maintaining the temperature of the developing conducting segment at a predetermined temperature higher than that of the input and output segments.

Numerous other features, objects and advantages of the invention will become apparent from the following specification when read in connection with the accompanying drawing in which:

DETAILED DESCRIPTION OF PREFERRED EMBODIMENTS

Figure 1:
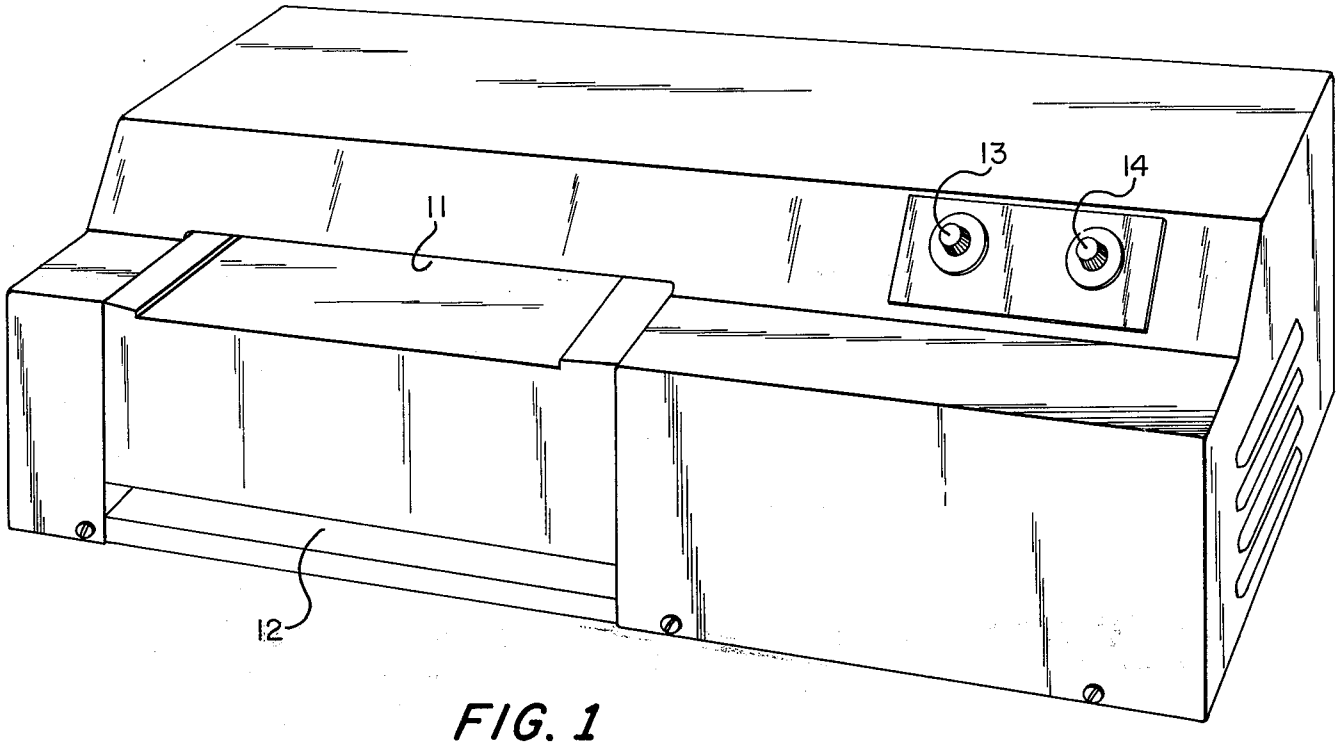
FIG. 1 is a perspective view of an exemplary embodiment of the invention.

With reference now to the drawing and more particularly FIG. 1, there is shown a perspective view of an embodiment of the invention having an input slot 11 for receiving film sheets to be developed, an output slot 12 for delivering developed film sheets, an on-off switch 13 and a speed control 14 for controlling the development time.

Figure 2:
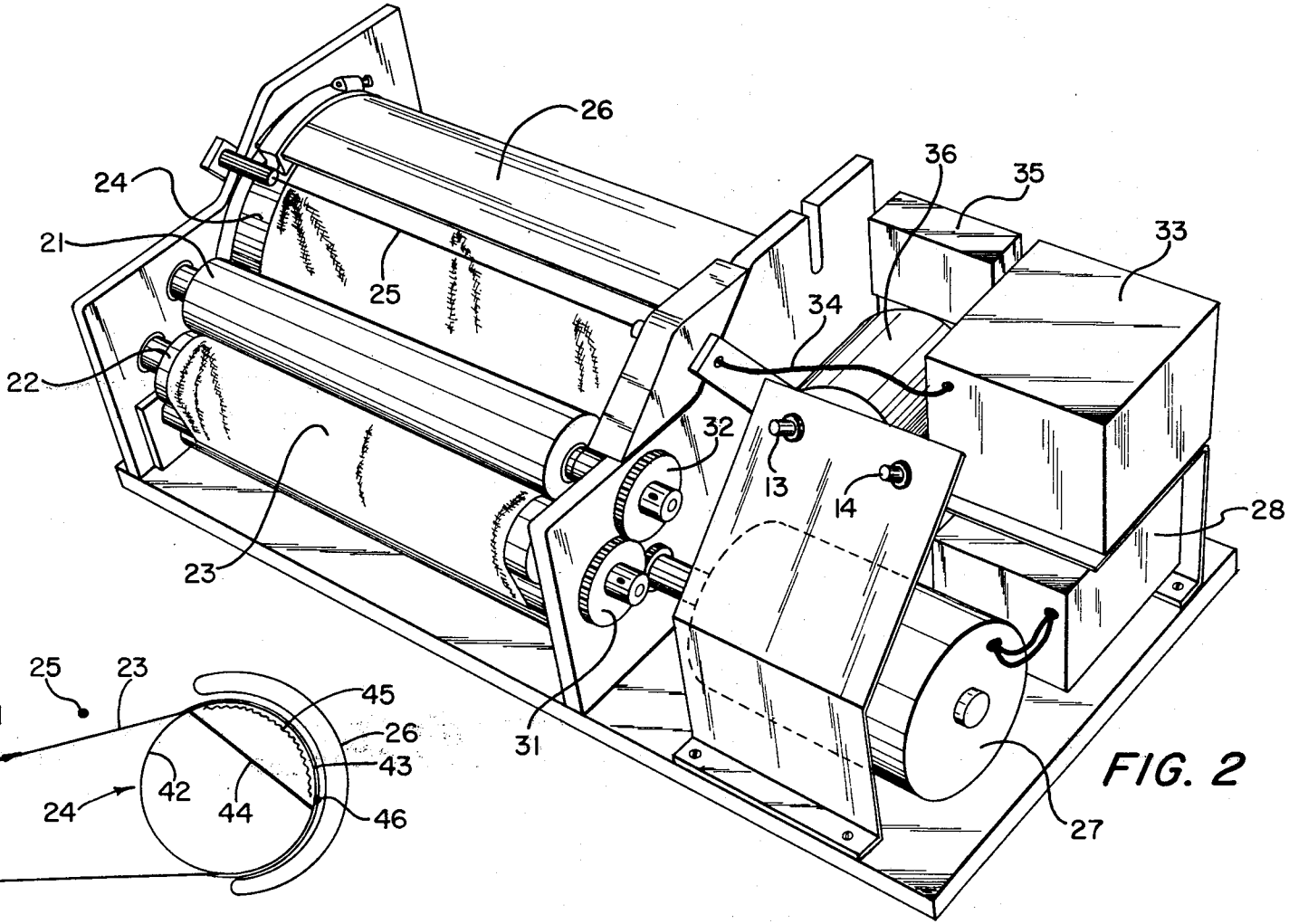
FIG. 2 is a perspective view of the embodiment of FIG. 1 with the cover removed to illustrate components of the invention.

Referring to FIG. 2, there is shown a perspective view of the embodiment of FIG. 1 with the cover removed to better illustrate the arrangement of system components. Input slot 11 (FIG. 1) faces the belt between the input segment and the input rollers 21 and 22 through which endless flexible belt 23 rides as it moves in a direction toward stationary drum 24 beneath wire electrode 25 that carries a high potential typically 10 K volts above ground potential. The conducting segments of drum 24 are maintained at ground potential. Belt 23 also passes below upper heating element 26 that is insulated on top and avoids contact with belt 23 or the film sheet carried thereby.

Drive motor 27 receives driving power from motor controller 28 to which speed control 14 is connected for driving rollers 21 and 22, directly driving gear 31 of roller 22 which meshes with gear 32 of roller 21 so that rollers 22 and 21 rotate clockwise and counterclockwise, respectively, to drive endless belt 23 clockwise around drum 24. High voltage supply 33 delivers a potential of 10 K volts to electrode 25 over high voltage cable 34.

A temperature controller 35 receives signals from thermistors (not shown) in contact with the developing segment of drum 24 and provides energy to the heating elements, one of which 26 is shown in FIG. 2, to maintain the temperature of the developing segment at substantially 255° F. A fan 36 blows air through the hollow portion of drum 24 to keep the input and output segments cooler than the developing segment 43 and preferably below 120° F.

Figure 3:
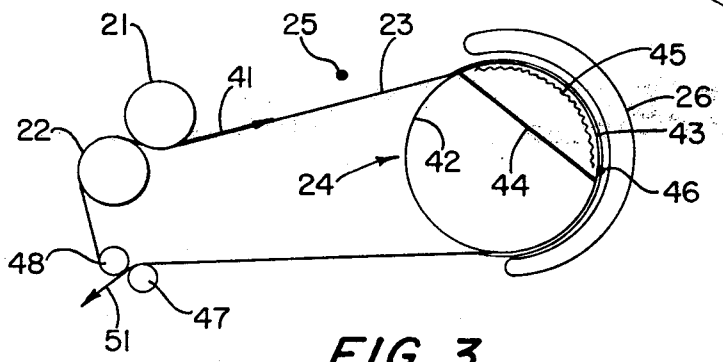
FIG. 3 is a diagramatic representation of a side view of the drum-roller-belt-heater-electrode assembly helpful in understanding the principles of the invention.

Referring to FIG. 3, there is shown a diagramatic representation of a side view of key elements in the embodiment helpful in understanding the principles of the invention. This view shows upper input roller 21 and lower input roller 22 with arrow 41 representing a sheet of film for development. Input and output segments 42 of drum 24 are typically made of aluminum and separated from developing segment 43 by insulating plate 44 typically made of asbestos, fiberglass or other suitable insulating material and coacting with input and output segments 42 to define a hollow chamber through which air may be blown by fan 36 (FIG. 2) to keep input and output segments 42 at a temperature below 120° F. Lower heating element 45 is in contact with developing segment 43 at a temperature of substantially 225° F. sensed by thermistor 46 in thermal contact with developing segment 43. Input and output conducting segments 42 and conducting segment 43 are maintained electrically at substantially ground potential to establish an electric field between electrode 25 and the drum segments that charges the film 41 and causes film 41 to be in firm contact over its entire area with endless belt 23 as it carries film 41 around drum 24 so that each elemental area of film 41 receives the same amount of heat as every other elemental area when passing over developing segment 43 maintained at uniform temperature and moving at uniform speed. As endless belt 23 moves over lower metal output roller 47 and beneath upper metal output roller 48, maintained substantially at ground potential, static electricity on endless belt 23 discharges along with the static electricity on developed sheet film represented by arrow 51 as the film exits through output slot 12 (FIG. 1) completely developed in the continuous process.

Endless belt 23 is typically a two layer belt comprising fiberglass impregnated with electrically conductive Teflon on the inside that contacts the surface of drum 24 to provide good electrical and thermal contact with drum 24 while the low coefficient of friction of the Teflon facilitates endless belt 23 moving around drum 24. The outer layer of belt 23 is typically 1/64 inch electrically conducting silicon rubber that holds the film in firm engagement with the belt while presenting relatively little thermal resistance, thermal resistance that is uniform, so that the film sheet surface area is uniformly heated with a relatively small thermal gradient across the belt. It is advantageous to have the outer layer impregnated with carbon to make the outer belt portion conductive although this conductive property is not always required for electrostatic hold down of the sheet film.

It is preferred that endless belt 23 be seamless; however, if it has a seam, means including a light source and an LED may be positioned to detect the seam and cause a "do not feed" light to light when the seam is in a position which would be opposite a film sheet if the film sheet were fed into input slot 11 when the light was lit. This LED-bulb assembly may be placed after upper roller 21 and cause the "don't feed" light to be extinguished after a predetermined time interval following sensing the seam depending upon the film sheet length.

While the invention is especially advantageous for continuous sheet film processing, the invention may also be used for roll film processing, especially when using a seamless endless belt.

The motor, motor controller, high voltage supply, lower fan and temperature controller are conventional commercially available components. For example, drive motor 27 is a Bodine type 535 motor and motor controller 28 is a Bodine type 901 motor controller. High voltage supply 33 is a Del Electronic Corp. type high voltage supply. Temperature controller 35 is a RFL Ind. Inc. type 70-115 temperature controller responsive to type 27687-7 thermistor secured to developing segment 43. Heating elements 26 and 45 are Wattlow Electric Co. heating elements.

There has been described novel apparatus and techniques for continuously developing thermally sheet film with apparatus that is relatively compact and inexpensive while introducing negligible development distortion into the film being processed. It is evident that those skilled in the art may now make numerous uses and modifications of and departures from the specific embodiments described herein without departing from the inventive concepts. Consequently, the invention is to be construed as embracing each and every novel feature and novel combination of features present in or possessed by the apparatus and techniques herein disclosed and limited solely by the spirit and scope of the appended claims.

What is claimed is:

1. Thermal developing apparatus comprising,
electrically and thermally conductive drum means having a heated developing segment,
belt means relatively moveable with respect to said drum means for carrying film to be developed across said heated developing segment,
and means for establishing an electrostatic field for producing electrostatic forces and static electricity on the belt means that keep the film to be developed in firm contact with said belt means as the latter carries the film around a portion of said drum means including said developing segment to uniformly develop the film.

2. Thermal developing apparatus in accordance with claim 1 wherein said drum means further comprises input and output segments thermally insulated from said developing segment and maintained at a temperature less than that of said developing segment.

3. Thermal processing apparatus in accordance with claim 2 wherein said belt means comprises an endless belt that moves around said drum means.

4. Thermal processing apparatus in accordance with claim 3 and further comprising means for discharging the static electricity on said belt means and the film carried thereby after the latter has been developed.

5. Thermal processing apparatus in accordance with claim 4 wherein said means for discharging comprises conducting output roller means around which said endless belt and the film pass after development.

6. Thermal processing apparatus in accordance with claim 1 and further comprising input driver roller means for frictionally engaging said belt means and driving it around said drum means.

7. Thermal developing apparatus in accordance with claim 1 wherein said belt means comprises an endless belt having a low friction inner surface and a high traction high release outer surface.

8. Thermal developing apparatus in accordance with claim 2 and further comprising,
fan means for removing heat from the input and output segments.

9. Thermal developing apparatus in accordance with claim 2 and further comprising,
heating elements for heating the developing segment.

* * * * *